United States Patent [19]

Walker

[11] 4,406,353

[45] Sep. 27, 1983

[54] WHEELED GARMENT BAG

[76] Inventor: Brooks Walker, 1280 Columbus Ave., San Francisco, Calif. 94133

[21] Appl. No.: 464,384

[22] Filed: Feb. 7, 1983

[51] Int. Cl.[3] ..... A45C 5/14; A45C 13/04; A45C 13/10

[52] U.S. Cl. ..... 190/18 A; 190/41 B; 190/43; 280/47.17

[58] Field of Search ..... 190/18 R, 18 A, 41 B, 190/43, 49; 280/DIG. 3, 37, 47.13 R, 47.17, 47.26

[56] References Cited

U.S. PATENT DOCUMENTS

| | | | |
|---|---|---|---|
| 1,616,632 | 2/1927 | Mastrontonio | 190/18 A X |
| 1,930,043 | 10/1933 | Evens | 190/41 B |
| 2,526,385 | 10/1950 | Meyer | 190/41 B X |
| 2,777,708 | 1/1957 | Patterson | 280/37 |
| 2,832,606 | 4/1958 | Patterson | 280/37 |
| 3,010,625 | 11/1961 | Glotzer | 190/41 B X |
| 3,115,959 | 12/1963 | Jaffe | 190/43 |
| 4,134,479 | 1/1979 | Crider, Jr. | 190/49 |
| 4,189,036 | 2/1980 | Pelavin | 190/43 |
| 4,262,780 | 4/1981 | Samuelian | 190/18 A |
| 4,354,583 | 10/1982 | Walker | 190/18 A |

FOREIGN PATENT DOCUMENTS

| | | | |
|---|---|---|---|
| 1563534 | 4/1969 | France | 190/18 A |
| 1099200 | 1/1968 | United Kingdom | 190/18 A |

*Primary Examiner*—William Price
*Assistant Examiner*—Sue A. Weaver

[57] ABSTRACT

A wheeled garment carry-on bag is constructed to permit the bag to be folded along a transverse fold line to a wheeled condition with the folded portions secured together and with the ground wheels outwardly of the bag. The bag is further constructed to permit the bag to be folded in a reverse manner to a carrying condition with the wheels between the folded portions to protect the wheels during transport.

9 Claims, 10 Drawing Figures

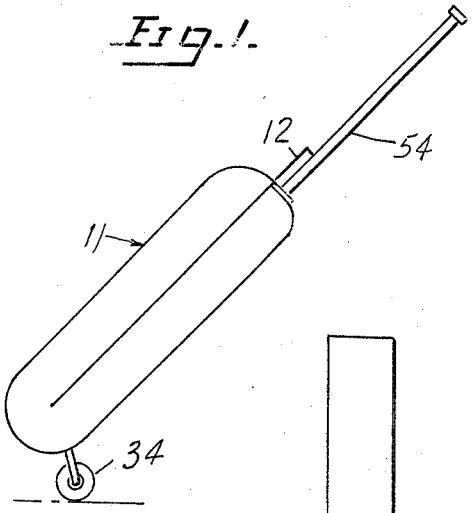
Fig. 1.
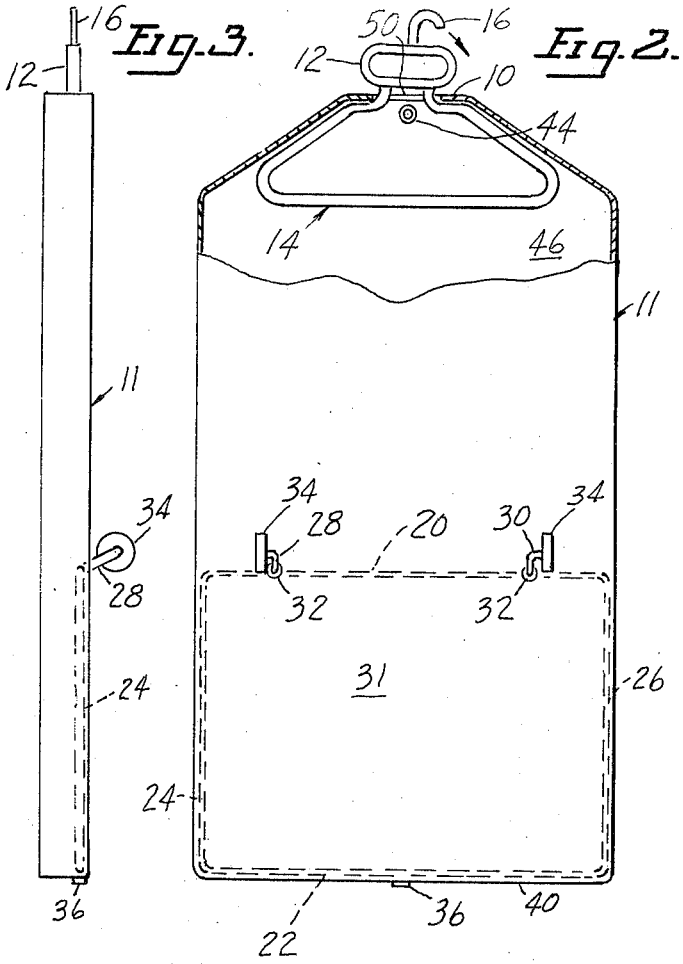
Fig. 2.
Fig. 3.
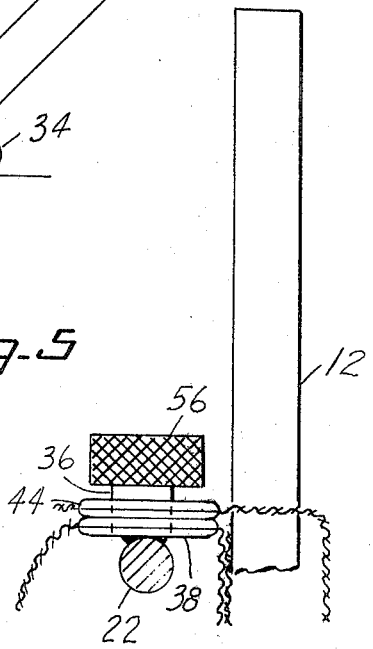
Fig. 5
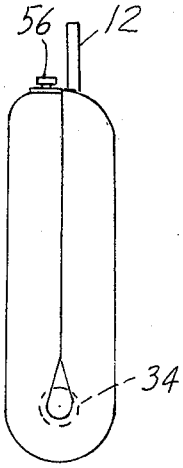
Fig. 4.
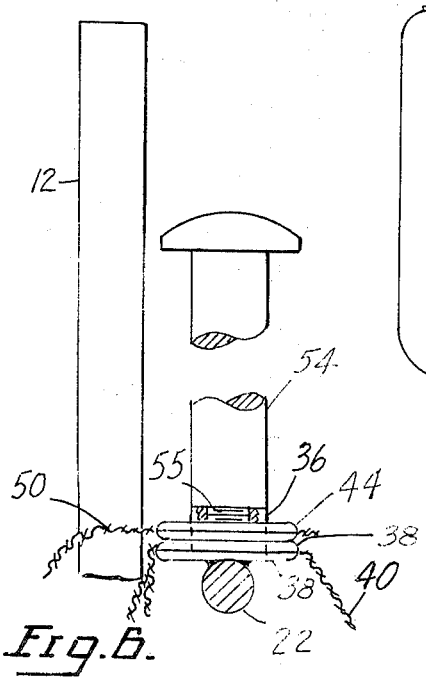
Fig. 6.
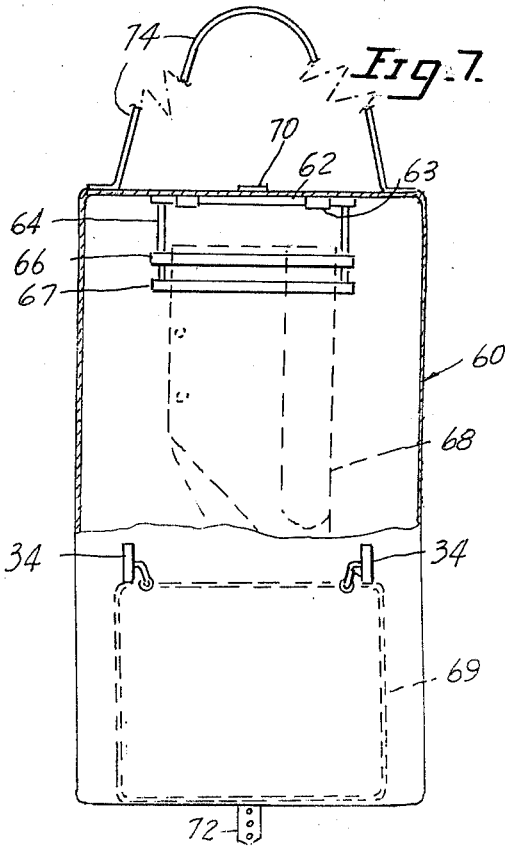
Fig. 7.

Fig. 8.
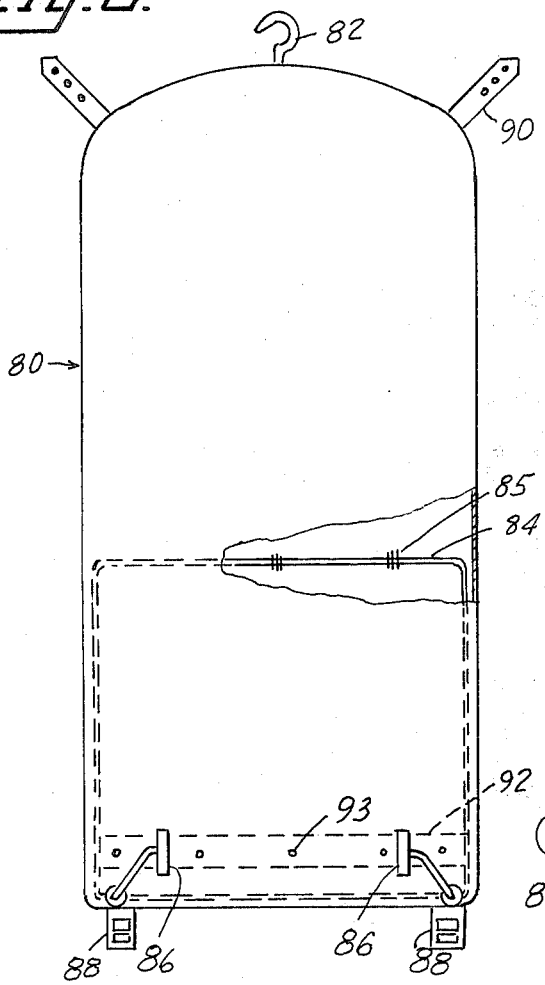
Fig. 9
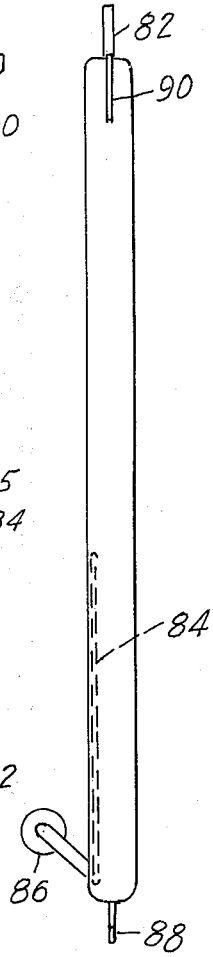
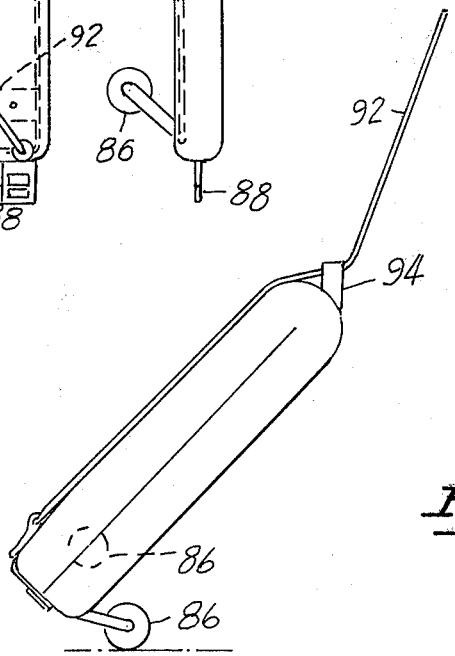
Fig. 10

WHEELED GARMENT BAG

This invention relates to a garment carry-on bag and more particularly to one provided with a wheeled carrier.

Heretofore, airline companies and associated baggage handlers have incurred heavy expenses caused by damage to the wheeled portions of various types of wheeled luggage. The widespread use of conveyors for moving luggage has aggravated the problem since the projecting wheels are readily snagged by adjacent structures resulting in the wheels being damaged or knocked off.

The main object of the present invention is the provision of a wheeled garment bag which, when in folded condition, protects the wheels from the above described type of damage.

Another object is the provision of a wheeled garment bag which is designed to contain the usual articles of clothing including trousers and coats and which may be stored in a relatively small space such as in the overhead lockers which are now being used in most aircraft.

Other objects and advantages will be apparent from the following specification and drawings:

FIG. 1 is a side elevation of the garment bag in wheeled condition.

FIG. 2 is a front elevation of the garment bag of FIG. 1 in unfolded condition and partly broken away.

FIG. 3 is a side elevation of the garment bag of FIG. 2.

FIG. 4 is an elevation similar to FIG. 1 but showing the bag folded to a carrying condition.

FIg. 5 is a greatly enlarged cross section showing the securing means for securing the folded portions of the bag in carrying condition.

FIG. 6 is a view similar to FIG. 5 but with the bag folded in wheeled condition.

FIG. 7 is a view similar to FIG. 2 but showing a garment bag of substantially less width than the conventional bag to permit the folded bag to be stored in a relatively small space.

FIG. 8 is a view similar to FIG. 2 but showing a different type of unfolded bag and with the wheels in an alternative position. Part of the front side is broken away to show internal structure.

FIG. 9 is a side elevation of the bag of FIG. 8.

FIG. 10 is a view similar to FIG. 1 and showing the bag of FIG. 8 in wheeled position.

In detail, and first with reference to FIG. 2 a somewhat conventional garment bag 11 is shown. As is well known, such bags differ in many ways with respect to location of zippers, the position of various external pockets and in other minor respects which do not affect the present invention. For this reason such features are omitted from the drawings and this description for clarity.

The upper wall 10 of the bag is apertured to permit the handle 12 of a clothes hanger 14 to project therethrough. This handle may be of the type incorporating a hook 16 which is swingable from the operative position shown to a position contained within the handle as indicated by the arrow.

At the lower end of the garment bag is a generally rectangular frame of relatively ligh wire of about 3/16" Dia. This frame includes a pair of upper and lower transversely extending portions 20,22 and a pair of longitudinally extending side portions 24,26. Other suitable frame material may be used.

Secured by brazing or welding to the upper transverse portion 20 are a pair of wheel supports 28,30 which may be of ¼" Dia,. wire and which pass through the adjacent front side 31 of the bag which can be reinforced by grommets 32 for receiving said supports therethrough. The supports 28,30 are preferably bent as indicated to rotatably receive thereon a pair of ground wheels 34.

Centrally of the lower transverse portion 22 is an internally threaded boss 36 which is integrally secured to portion 22 and passed through grommet 38 (FIGS. 5,6) secured to the bottom 40 of the bag.

The boss 36 is adapted to cooperate, in a manner to be described, with a grommet 44 secured to the rear side 46 of the bag adjacent the upper end of the latter. When the bag is folded to the position of FIG. 1 the relatively thin material of the bag permits the central upper end 50 of the bag and grommet 44 to be stretched and positioned as indicated in FIG. 6 with the boss 36 extending through grommet 44 thus holdling the folded portions of the bag together as shown in FIG. 1.

As best seen in FIGS. 1,6 an elongated towing handle 54 is formed at its lower end with a reduced diamenter externally threaded extension 55 which is adapted to be threadedly received in the internally threaded boss 36 (FIG. 6). In this manner the garment bag may be wheeled as indicated in FIG. 1.

In order to orient the garment bag in the carrying position of FIG. 4 the two upper and lower portions are swung in the reverse manner from the elongated form of FIG. 2 so that the wheels 34 are interposed between the folded portions as shown in FIG. 4. In this case, as shown in FIG. 5, a short knurled head bolt 56 may be threadedly secured within boss 36 to hold the two gromments 40,38 together thus holding the folded portions of the bag in carrying condition shown in FIG. 4.

A modified form of the bag of FIG. 2 is shown in FIG. 7 wherein the bag 60 is not provided with a conventional hanger but which incorporates a stiffener 62 formed of light material such as a wooden rod which is secured by stitched tabs 63 to the inner surface of the top of the bag. Suspended from said stiffener 62 as by light weight cords 64 is a second rod 66 which is adapted to receive a relatively narrow folded garment thereover such as a jacket indicated by dotted lines 68. It is contemplated that such a jacket may be first folded along a longitudinally extending fold line and then draped over rod 66 so that the width of the bag, when finally folded to its carrying position, takes considerably less space than the conventional garment bag. In this connection it will be understood that in many aircraft the storage spaces are not large enough to accommodate the width of a conventional garment bag. A second hanger rod 67 may be provided if desired to hold trousers, for example. In this case the frame 69 is narrower than the width of the garment bag so that the sides of the bag may be compressed if necessary to be accommodated in a small space.

To permit the bag to be folded either to a wheeled condition or to a carrying condition a conventional buckle 70 may be stitched to the top of the bag and an apertured strap 72 secured to the bottom of the bag. In this case a shoulder strap 74 may be provided for either carrying the bag on the user's shoulder or for pulling the bag when in wheeled position.

Another modified form is shown in FIG. 8 wherein a conventional garment bag 80 is apertured at its top in the usual manner to receive the hook 82 of a conventional clothes hanger therethrough. As in the form of FIG. 2 a wire frame 84 is provided at the lower end of the bag and may be secured to the material of the bag by stitching 85. However in this case the wheels 86 are secured to the lower transverse portion of the frame as indicated. As in the previously described forms the bag can be folded in either direction to a carrying condition or a wheeled condition. To hold the two portions together a buckle 88 may be provided adjacent each of the bottom corners and an apertured strap 90 at each of the upper corners.

As best seen in FIG. 10, a tether 92 may be passed through a central strap 94 and secured to the top of the bag for pulling the wheeled bag.

A stiffener 92 of light weight material such as wood may be secured to the bag by rivets 93 or other suitable fasteners to hold the side of the bag away from the wheels 86 when the bag is wheeled and loaded.

When folded to a carrying condition the bag 80 is oriented similar to the bag 11 of FIG. 2 except that the wheels are positioned adjacent the ends of the bag as indicated by dotted lines in FIG. 10.

It will be noted that the straps 90 and buckles 88, when connected tightly, pull the two portions of the bag over the wheels so that they are not free to catch on adjacent objects.

I claim:

1. A wheeled article of luggage comprising:

an elongated garment carry-on bag adapted to be folded on itself along a transverse fold line, a frame secured to said bag for stiffening at least a portion of said bag, a pair of ground wheels, a pair of wheel supporting members secured at one end to said frame and extending through a wall of said bag and rotatably supporting said ground wheels at their opposite ends, means for securing together the folded portions of said bag when the latter is folded along said fold line with said ground wheels positioned outwardly of said bag, and means for securing together the folded portions when said bag is folded in the opposite direction with said wheels positioned between said folded portions.

2. An article according to claim 1 wherein an elongated towing handle is removably secured to said bag when said bag is folded with the wheels outwardly thereof.

3. An article according to claim 1 wherein said frame is generally rectangular and encompasses a substantial portion of one half of said bag.

4. An article according to claim 3 wherein the upper end of said bag is apertured to permit the upper portion of a clothes hanger to extend therethrough and the lower end only of said bag contains said stiffening frame.

5. An article according to claim 4 wherein said ground wheels are connected to said frame at the upper end of said frame.

6. An article according to claim 4 wherein said ground wheels are connected to said frame at the lower end of said frame.

7. An article according claim 6 wherein fastening means are provided for securing together the folded portions of the bag at points adjacent and outwardly of said wheels when the latter are between said folded portions.

8. An article according to claim 1 wherein said bag is of a width substantially less than that of a conventional garment bag, a hanger secured to the top of said bag to receive a relatively narrow article of clothing.

9. An article according to claim 8 wherein a second hanger spaced from and parallel to said first mentioned hanger is provided.

* * * * *